US006422244B1

(12) United States Patent
Clarke et al.

(10) Patent No.: US 6,422,244 B1
(45) Date of Patent: Jul. 23, 2002

(54) FILTER FOR A CIGARETTE AND FILTER CIGARETTE

(75) Inventors: Paul Clarke, Morpeth; John Charlton, Washington, both of (GB); Ichiro Atobe; Masanori Koborinai, both of Tokyo (JP)

(73) Assignees: Japan Tobacco, Inc., Tokyo (JP); Filtrona International Ltd., London (GB)

( * ) Notice: Subject to any disclaimer, the term of this patent is extended or adjusted under 35 U.S.C. 154(b) by 0 days.

(21) Appl. No.: 09/624,393

(22) Filed: Jul. 24, 2000

(30) Foreign Application Priority Data

Jul. 29, 1999 (GB) ..... 9917819

(51) Int. Cl.[7] ..... A24D 3/04

(52) U.S. Cl. ..... 131/340; 131/339; 131/338; 131/336

(58) Field of Search ..... 131/339, 340, 131/210, 336, 344, 202, 201, 200, 212.1, 338

(56) References Cited

U.S. PATENT DOCUMENTS

| | | | | |
|---|---|---|---|---|
| 3,552,399 A | | 1/1971 | Andreas | |
| 4,291,712 A | | 9/1981 | Koster et al. | |
| 5,979,459 A | * | 11/1999 | Schneider | 131/338 |

FOREIGN PATENT DOCUMENTS

| | | |
|---|---|---|
| GB | 2122066 | 1/1984 |
| GB | 2161362 | 1/1986 |
| GB | 2184337 | 6/1987 |

* cited by examiner

*Primary Examiner*—James Derrington
*Assistant Examiner*—Dionne A. Walls
(74) *Attorney, Agent, or Firm*—Birch, Stewart, Kolasch & Birch, LLP

(57) ABSTRACT

A filter for a cigarette and a filter cigarette which make a smoking feeling much milder without the original cigarette taste and aroma being spoiled are provided. The cigarette filter has a filter rod 8 having an air permeable peripheral surface, and 3 to 12 axial passages 12 in the rod 8. These passages 12 are distributed on a ring having a diameter of 50 to 70% of that of the rod and have a diameter of 0.1 to 0.7 mm. The wall of the axial passages 12 have air permeability. In smoking, ventilation air introduced into the passages 12 dilutes the smoke stream from the cigarette.

14 Claims, 4 Drawing Sheets

FILTER FOR A CIGARETTE AND FILTER CIGARETTE

TECHNICAL FIELD

The present invention relates to a filter for a cigarette and a filter cigarette using the filter.

BACKGROUND ART

A filter of this type is known which has a plurality of axial holes therein extending from one end of the filter to the other. The axial holes are formed by tubes embedded in the filter (see U.S. Pat. No. 3,546,325) or by thermoforming. The thermoforming is carried out by melting part of the filter using a laser beam (see U.S. Pat. No. 4,291,712) or a pin-like heating tool.

Such a filter makes it possible to introduce part of the main smoke stream from the cigarette directly and without filtering treatment into the smoker's mouth.

In recent years, many smokers have shown a tendency to like a milder smoking feeling without loss of enjoying an original cigarette aroma or flavor. Therefore, it is necessary to optimally control the amount of smoke stream which is introduced into the smoker's mouth through the axial holes of the filter; the axial holes of the prior filters, however, deliver the smoke stream from the cigarette directly into the smoker's mouth, and there is therefore a limit to the extent to which the smoking feeling can be lightened.

DISCLOSURE OF INVENTION

A cigarette filter according to the invention comprises a filter rod which has an air permeable peripheral surface and in which 3 to 12 continuous passages extend between open ends at the two ends of the rod, the passages being distributed on a ring having a diameter of 50 to 70% of that of the rod, and each the passages having a diameter of 0.1 to 0.7 mm and the wall of each said passage having air permeability.

The filter rod which has an air-permeable peripheral surface may for example be a body of filtering material held in rod form by an air-permeable circumferential wrapper; it might instead be a filter rod which is coherent and self-supporting and dimensionally stable without a circumferential wrapper—examples of this being made of fibers or filaments bonded at points of contact into permeable rod form, such as the commercially available NWA filter rods of bonded cellulose acetate filaments. Where the filter rod does not itself need a wrapper to maintain its rod configuration, it may nonetheless be provided with a ventilating wrapper—e.g. one which joins it to a longitudinally adjacent rod to form a composite filter, and/or a ventilating tipping overwrap which joins it to a tobacco rod to form a filter cigarette.

The filter is usually connected to a cigarette through tipping paper having air permeability. When the filter cigarette is smoked, ventilation air is introduced into the rod through the tipping paper and then into the passages through theirwalls. The smoke stream which passes through the passages is therefore diluted by the ventilation air for delivery to the smoker. With the diameter and the number of the passages limited as above, the amount of the main smoke stream diluted by the ventilation air is optimal to give a mild smoke while providing the smoker the original taste and aroma of the cigarette.

The passages may be made by heating the filter material with vapor so as to thermoform the filter material without melting.

Preferably, each of the passages has a diameter of 0.2 to 0.5 mm. The axial air-flow resistance of the filter, that is, resistance to draw (RTD) through the filter, is preferably 80 to 160 $mmH_2O$.

The filter may include, at an end thereof, a tip having a length of 2 to 20 mm which is correspondingly 8 to 60% of the total length of the filter, and having RTD of 80 or less $mmH_2O/25$ mm; a tip e.g. a plain filter tip makes it easy to adjust the RTD of the whole filter.

The amount of ventilation air introduced radially into the filter is preferably 20% or more, more preferably 70 to 80%, of the total amount of air flowing into the filter. By adjusting the amount of ventilation air, the amount of tar delivered to the smoker through the filter can be determined.

BRIEF DESCRIPTION OF DRAWINGS

Referring to FIG. 1, a filter cigarette has a cigarette 2, and a filter 6 connected to one end of the cigarette 2 through tipping paper 4. The filter 6 is formed by wrapping a filter material 8 in cylindrical form with a wrapper 10. The filter material 8 is one usually used for this type of filter, e.g. a tow of acetate. The density of the fibers in the cylindrical filter material 8 is preferably uniform over the cross-sectional area thereof.

Figure 1:
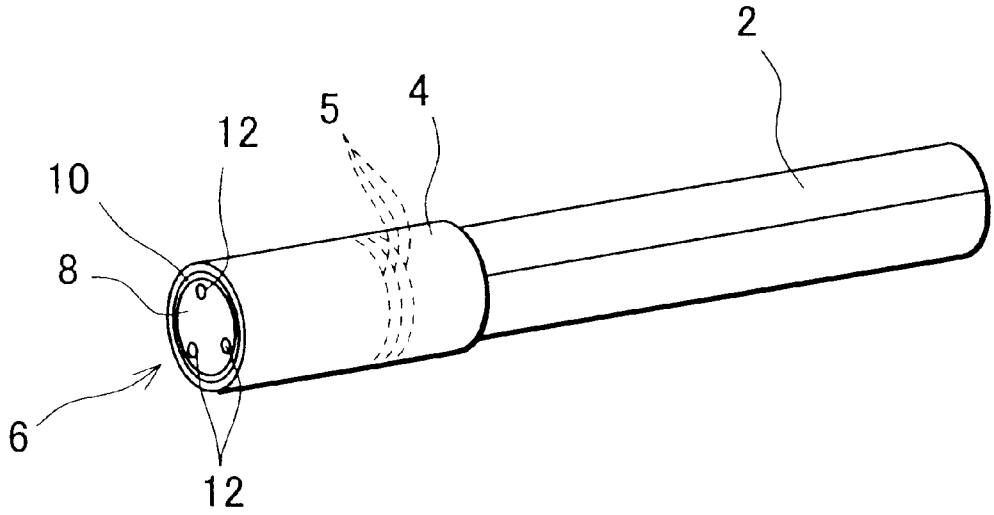
FIG. 1 shows a perspective view of a filter cigarette.
Figure 2:
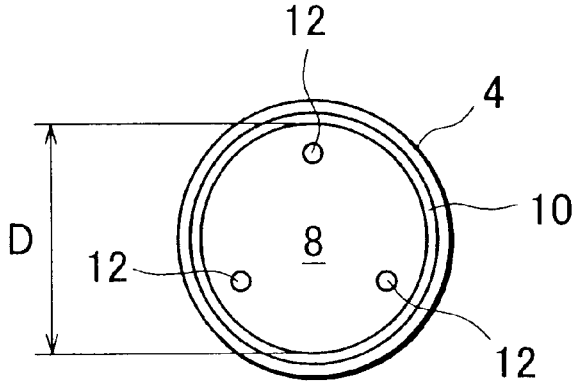
FIG. 2 shows the mouthpiece end of the filter cigarette shown in FIG. 1.
Figure 3:
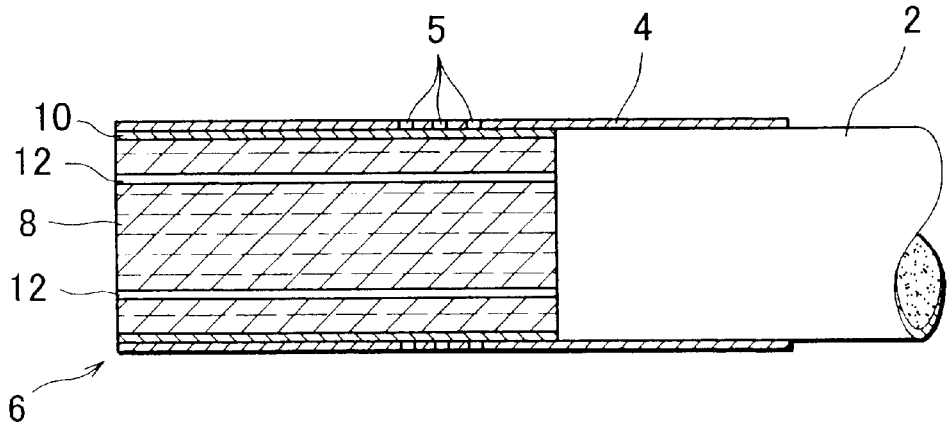
FIG. 3 illustrates a part of the cross section of the filter cigarette shown in FIG. 1.

The wrapper 10 and the tipping paper 4 have air permeability so that ventilation air can be introduced through them into the filter material 8 from the outside. Usually wrapper 10 is of air permeable paper and tipping paper 4 has perforations 5 which may be distributed around the filter 6 in a row or rows as shown.

The filter material 8 also has axial passages 12 therein which extend from the mouthpiece end of the filter 6 to the cigarette 2. Each of the passages 12 may be made by thermoforming the filter material 8. The thermoforming process can use the heat of vapors—for example, U.S. Pat. No. 4,022,221 discloses the formation of passages by such a thermoforming process. By such processes passages 12 are formed without melting the filter material 8 so that the passages 12 have air-permeable walls.

When the filter cigarette is smoked, a large part of the smoke stream from the cigarette 2 is filtered through the filter material 8 and then delivered to the smoker as a filtered smoke stream; the remaining part smoke stream is delivered to the smoker through the passages 12 without being filtered.

Ventilation air is introduced into the filter material 8 through the perforations 5 and wrapper 10 and then into the passages 12 through their walls. The smoke stream passing through the axial passages 12 is diluted by the ventilation air and the diluted smoke stream is delivered to the smoker. The main smoke stream of the cigarette is not delivered directly to the smoker, who receives the filtered smoke stream and the diluted smoke stream to get a mild smoking feeling.

The diluted smoke stream keeps the original cigarette taste and aroma. Thus the smoker can enjoy the cigarette aroma or flavor even with a milder smoking feeling.

The axial passages 12 are distributed on a ring having a diameter of 50 to 70% of the diameter D of the cylindrical filter material 8. The diluted smoke stream delivered to the smoker is an important factor which greatly affects the original cigarette aroma or flavor and the feeling of smoke volume, and is preferably drawn out uniformly from the mouthpiece end of the filter 6. Therefore, as shown, the axial passages 12 are preferably equally spaced on the ring which is coaxial with the cylindrical filter material 8.

The number of the axial passages 12 may be from 3 to 12, but is preferably 3 for ease of forming of the passages.

If the diameter of the distribution ring for the passages 12 is over 70% of the diameter D of the filter material 8, the space between the outer periphery of the filter material 8 and the axial passage 12 is so thin that it is difficult to form the axial passages 12; if it is less 50% of the diameter D, said space is so thick that it is substantially impossible to introduce ventilation air into the passages 12 to dilute the smoke stream therein.

Figure 4:
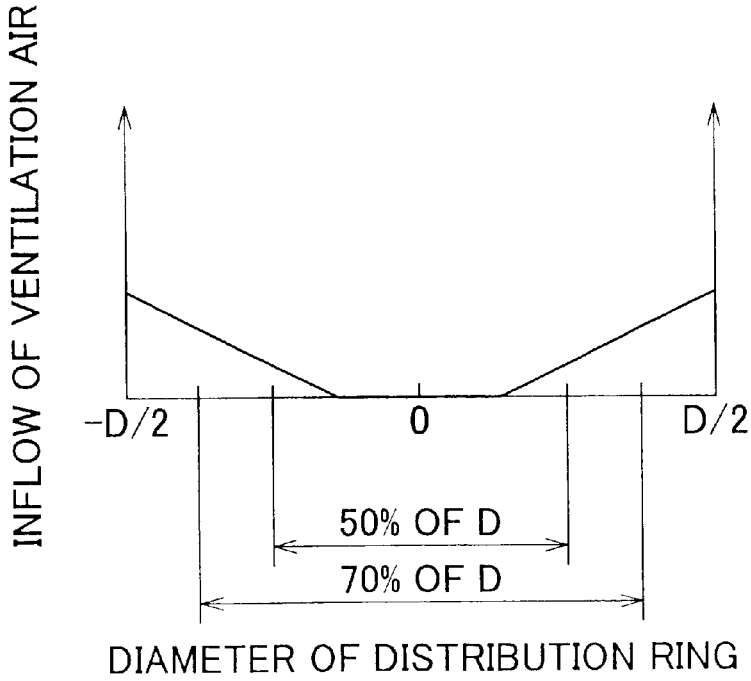
FIG. 4 is a graph of percentages of the amount of ventilation air which is introduced into the filter.

As shown in FIG. 4, the inflow of ventilation air introduced through the outer peripheral surface of the filter 6 decreases gradually towards the center of the filter material 8, and no ventilation reaches the center portion. For this reason, to introduce ventilation air into the passages 12, it is necessary to position the passages on a ring the diameter of which is 50 to 70% of the diameter D.

The graph of FIG. 4 shows results measured using a device obtained by modifying an ordinary automatic smoking device for measuring amounts of nicotine and tar of a filter cigarette. The modified device automatically smokes a filter cigarette under standard smoking conditions, without lighting the filter cigarette. The automatic smoking is executed with that smoke of a cigarette or cigarettes introduced into the filter 6 only through the perforations 5. During the automatic smoking, the smoke flows into the filter material 8, which catches tar included in the introduced smoke. Observation of the distribution of tar over the cross-sectional area of the filter material 8 makes it possible to estimate the inflow of ventilation air into the filter material 8.

The diameter of the passages 12 should be from 0.1 to 0.7 mm. If it is less than 0.1 mm, the outflow of diluted smoke stream from the passages 12 is so small that the smoker cannot enjoy the original taste and aroma of the cigarette and further it is difficult to thermoform the axial passages 12; if it is more than 0.7 mm, the outflow of diluted smoke stream is so large that a mild smoking feeling cannot be obtained, and the axial air-flow resistance, that is, resistance to draw (RTD) of the filter 6 is reduced so much that the smoker will have a physiological bad feeling. The RTD of the filter 6 is preferably 80 to 160 $mmH_2O$, and more preferably 100 to 135 $mmH_2O$. When there are 3 passages 12, however, the RTD of the filter 6 falls to much less than 80 mm $H_2O$ when the diameter of the passages 12 is over 0.7 mm. The diameter of the passages 12 is most preferably 0.2 to 0.5 mm.

Figure 5:
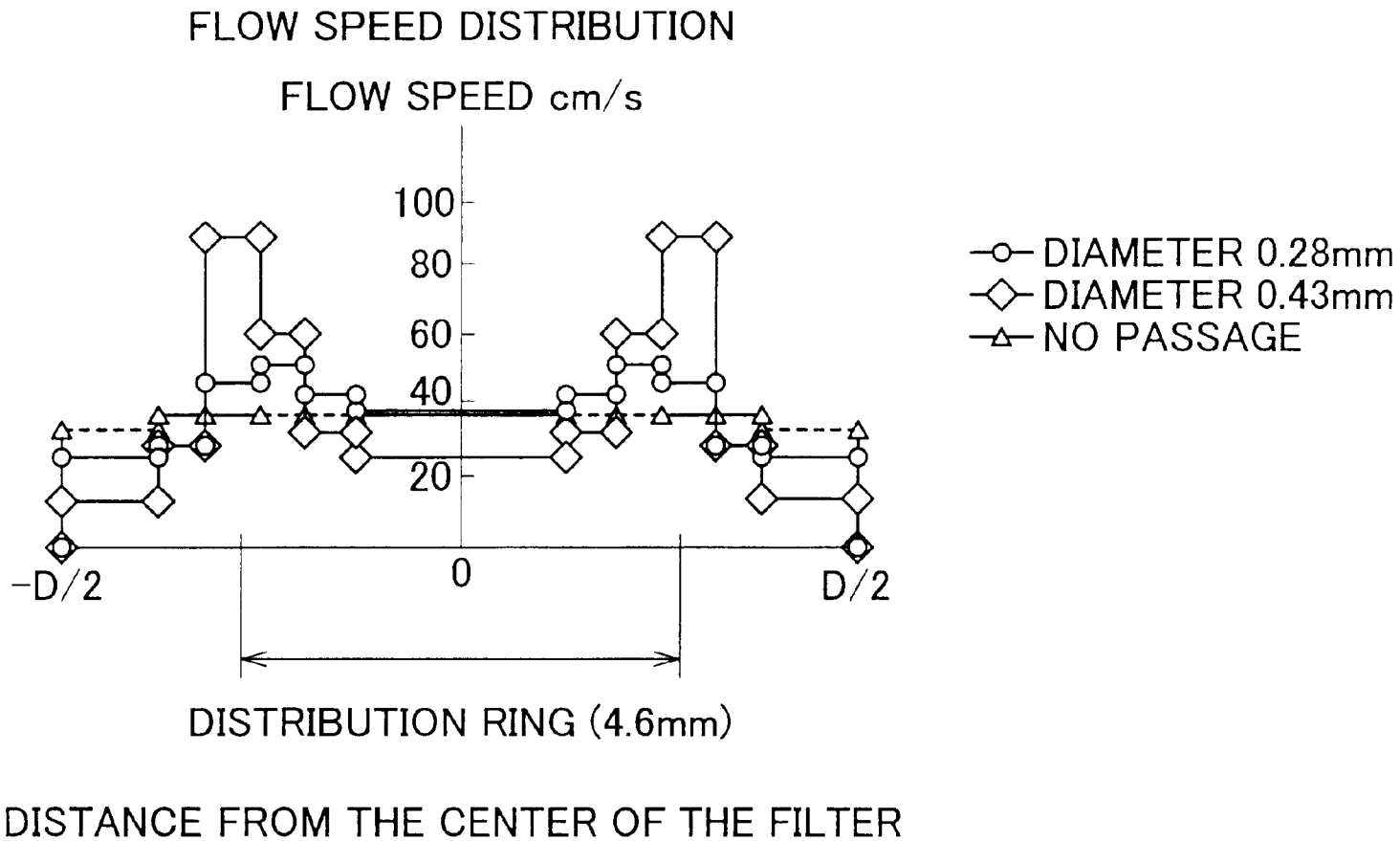
FIG. 5 is a graph of flow speed distribution at the mouthpiece end of the filter cigarette.

FIG. 5 shows distribution of the flow speeds at the mouthpiece end of the filter 6 when a filter cigarette with the filter 6 is drawn under standard smoking conditions. In this figure, plot marks ○ and ◇ denote filter cigarettes the passages 12 of which have diameters of 0.28 mm and 0.43 mm, respectively. Plot marks Δ denote a filter cigarette the filter of which has no axial passages. The diameter D of the filters is 8 mm, and the filters 6 have 3 passages 12 spaced equally around a 4.6 mm diameter circle.

As is evident from FIG. 5, the filter cigarettes having the passages 12 show higher flow speeds than that having no axial passages. As the diameter of the passages 12 increases, the flow speeds in them increase. It is preferred for the diameters of the axial passages 12 to be between those denoted by the plot marks ○ and ◇, e.g., about 0.35 mm.

The overall cross-sectional area of the passages 12 is preferably 0.0236 to 0.472 $mm^2$. When there are 3 passages 12 diameter 0.35 mm, the overall cross-sectional area is 0.288 $mm^2$.

The following Table 1 shows the specifications and the RTD of various filters 6.

TABLE 1

| Sort | Diameter of axial passages (mm) | Number of axial passages | Distribution ring of axial passages (mm) | RTD ($mmH_2O$) |
|---|---|---|---|---|
| A | 0.40 | 3 | 4.4 | 108 |
| B | 0.28 | 3 | 4.6 | 105 |
| C | 0.33 | 4 | 4.1 | 105 |
| D | 0.26 | 4 | 4.3 | 106 |
| E | 0.43 | 3 | 4.6 | 103 |

The length of the filter 6 is 25 mm, tow specification of the filter materials 8 is 5Y/80,000 (i.e., 5 filament denier, Y shape/80,000 total denier; this applies to similar expressions appearing hereinafter), and the wrapper 10 is porous paper of 24000 CU (i.e., 24,000 Coresta units; this applies to similar expressions appearing hereinafter).

Figure 6:
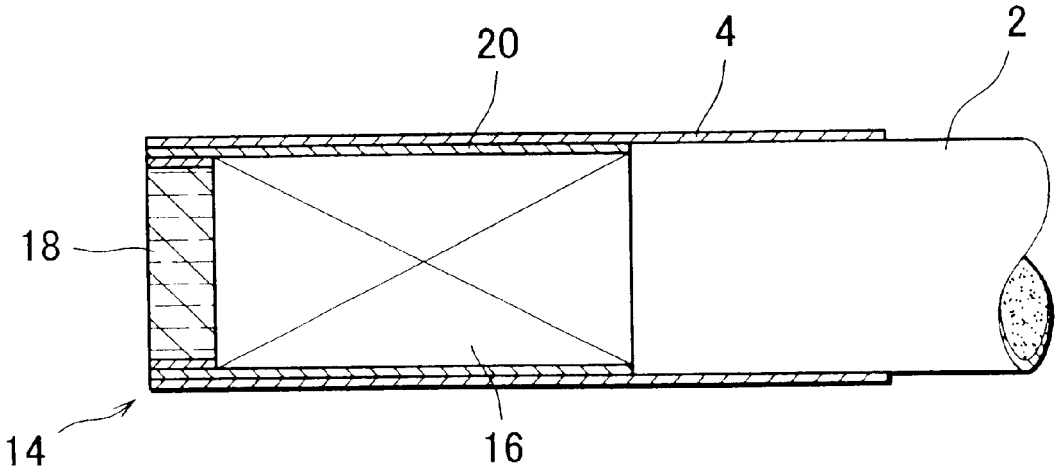
FIG. 6 shows another filter for a cigarette.

FIG. 6 illustrates another embodiment of the present invention. The filter 14 of FIG. 6 has a filter portion 16 similar to the above-mentioned filter 6, and a plain filter 18 which is connected to one end of the filter portion 16 as a mouthpiece end of the filter 14. The filter portion 16 and the tip 18 are connected to each other through an outer wrapper 20. The outer wrapper 20 is made of the same porous paper as the wrapper 10 for the filter portion 16. The tip 18 is made of wrapper 10 for the filter portion 16. The tip 18 is made of a tow of acetate fibers and wrapped cylindrically with plug wrapper.

The length of the tip 18 is 8 to 60% of the total length of the filter 14, i.e., 2 to 20 mm. The RTD of the tip 18 is 80 or less $mmH_2O$/25 mm. When the total length of the filter 14 is , for example, 25 mm, the length of the tip 18 is 2 to 15 mm, preferably 5 mm.

Though the filter 14 has the tip 18 at the mouthpiece end thereof, the diluted smoke stream which has passed through the passages in the filter portion 16 is delivered to the smoker. without substantial filtration when the RTD of the tip 18 is very low. When the filter cigarette is smoked, the smoker can therefore receive a filtered smoke stream and a diluted smoke stream which is not substantially filtered. This provides a good smoking feeling to the smoker. The tip 18 also has the advantage of hiding tar caught on the inner walls of the passages 12 of the filter portion 16.

Preferably, the tip 18 is as short as possible to prevent damage to the flow speed distribution of the smoke delivery from the filter portion 16. To reduce it's RTD, it is preferable to use for the tip 18 a filter material of thick fibers. The filter material for the tip 18 has a tow specification of 8Y/39000, for example.

Figure 7:
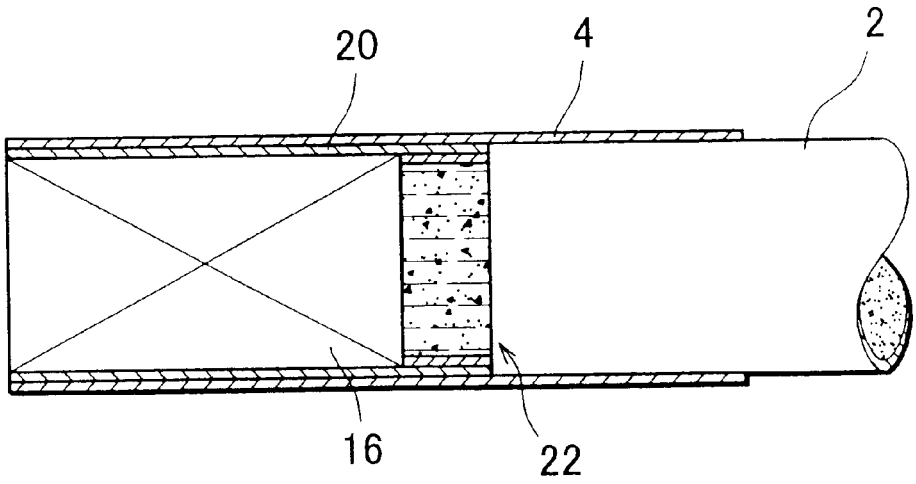
FIG. 7 shows still another filter for a cigarette.

The filter 18 may be arranged instead between the filter portion 16 and the cigarette 2. In this case, a charcoal filter 22 may be used instead of the plain filter 18, as illustrated in FIG. 7. The charcoal filter 22 is formed by admixing particles of charcoal into the plain filter 18.

The following Table 2 shows specifications and RTD of various filters 14 as shown in FIG. 6.

TABLE 2

| Sort | Filter portion: Diameter of axial passages (mm) | Number of axial passages | Distribution ring of axial passages (mm) | RTD ($mmH_2O$/20 mm) | Tip RTD ($mmH_2O$/5 mm) | Total RTD ($mmH_2O$/25 mm) |
|---|---|---|---|---|---|---|
| F | 0.43 | 3 | 4.3 | 88 | 7 | 93 |
| G | 0.27 | 3 | 4.3 | 92 | 7 | 98 |
| H | 0.33 | 4 | 4.3 | 89 | 7 | 100 |
| I | 0.27 | 4 | 4.0 | 94 | 7 | 103 |
| J | 0.26 | 3 | 5.0 | 100 | 7 | 110 |

The following Table 3 shows properties of cigarettes which have filters A–J , respectively, and whose target tar values are from 1 to 3 mg.

TABLE 3

| Sort | Cigarette: Vf (%) | RTD (mm $H_2O$) | T (mg/cig) | Tar (T), Nicotine (N): N (mg/cig) | CO (mg/cig) | CO/T | Number of puff |
|---|---|---|---|---|---|---|---|
| A | 80 | 74 | 1.4 | 0.16 | 0.8 | 0.57 | 7.6 |
| | 76 | 79 | 2.0 | 0.22 | 1.1 | 0.55 | 7.1 |
| | 76 | 79 | 2.2 | 0.24 | 1.2 | 0.55 | 7.2 |
| B | 78 | 77 | 1.6 | 0.18 | 1.0 | 0.63 | 7.2 |
| | 78 | 78 | 1.5 | 0.16 | 0.8 | 0.53 | 7.1 |
| | 78 | 78 | 1.5 | 0.16 | 0.9 | 0.60 | 7.1 |
| C | 74 | 79 | 2.3 | 0.23 | 1.1 | 0.48 | 7.1 |
| | 76 | 78 | 2.5 | 0.26 | 1.3 | 0.52 | 7.0 |
| | 79 | 74 | 1.7 | 0.19 | 0.7 | 0.41 | 7.0 |
| D | 82 | 73 | 1.0 | 0.12 | 0.6 | 0.60 | 7.5 |
| | 81 | 73 | 1.2 | 0.15 | 0.6 | 0.50 | 7.2 |
| | 80 | 74 | 1.3 | 0.16 | 0.6 | 0.46 | 7.2 |
| E | 78 | 76 | 1.8 | 0.22 | 0.9 | 0.50 | 7.3 |
| | 76 | 78 | 2.0 | 0.22 | 0.9 | 0.45 | 7.1 |
| | 75 | 78 | 2.2 | 0.26 | 1.1 | 0.50 | 7.1 |
| F | 77 | 68 | 2.0 | 0.24 | 1.1 | 0.55 | 7.1 |
| | 74 | 70 | 2.4 | 0.28 | 1.2 | 0.50 | 7.0 |
| | 74 | 71 | 2.4 | 0.28 | 1.2 | 0.50 | 7.0 |
| G | 79 | 68 | 1.4 | 0.18 | 0.8 | 0.57 | 7.2 |
| | 78 | 69 | 1.6 | 0.18 | 0.9 | 0.56 | 7.0 |
| | 77 | 70 | 2.0 | 0.20 | 1.4 | 0.70 | 7.2 |
| H | 76 | 71 | 2.4 | 0.25 | 1.6 | 0.67 | 7.1 |
| | 75 | 71 | 2.2 | 0.26 | 1.6 | 0.73 | 7.2 |
| | 73 | 73 | 2.7 | 0.27 | 1.4 | 0.52 | 7.0 |
| I | 80 | 68 | 1.3 | 0.16 | 1.0 | 0.77 | 7.3 |
| | 79 | 66 | 1.3 | 0.16 | 1.0 | 0.77 | 7.1 |
| | 79 | 67 | 1.5 | 0.18 | 1.1 | 0.73 | 7.0 |
| J | 80 | 69 | 1.3 | 0.14 | 1.0 | 0.77 | 7.1 |
| | 80 | 70 | 1.3 | 0.14 | 1.0 | 0.77 | 7.3 |
| | 80 | 69 | 1.6 | 0.17 | 1.2 | 0.75 | 7.0 |
| Normal | 62 | 86 | 1.6 | 0.19 | 1.8 | 1.13 | 7.0 |
| | 68 | 90 | 1.9 | 0.22 | 2.3 | 1.21 | 7.0 |
| | 64 | 94 | 2.6 | 0.26 | 2.6 | 1.00 | 6.8 |

The cigarettes 2 used each had a length of 58 mm, and a tar level of 20 mg. In Table 3, the air permeability of the tipping paper differs for each sort of cigarette filter.

As is clear from Table 3, when the filter cigarettes A to 'normal' have the same target tar level, the filter cigarettes A to J have a percentage Vf of ventilation air of 70 to 80, which is higher than for the cigarette with the normal filter. As a result, the filter cigarette filters A–J can. have by far lower CO/T than the cigarette with the normal filter.

The target tar level for Table 3 is 1 to 3 mg. When it is about 6 mg, Vf can be decreased, and a value of 20% or more may suffice.

What is claimed is:

1. A cigarette filter comprising a filter rod which has an air permeable peripheral surface and in which 3 to 12 continuous passages extend between open ends at the two ends of the rod, said passages being distributed in a ring configuration having a diameter of 50 to 70% of that of the rod, and each said passage having a diameter of 0.1 to 0.7 mm and the wall of each said passages having air permeability.

2. A filter according to claim 1 wherein each said passage has a diameter of 0.2 to 0.5 mm.

3. A filter according to claim 1 having an air-flow resistance of 80 to 160 $mmH_2O$.

4. A filter according to claim 1 including a tip having a length of 2 to 20 mm which is correspondingly 8 to 60% of the total length of said filter and having an air-flow resistance of 80 or less $nmuH_2O$/25 mm.

5. A filter cigarette according to claim 4, wherein said length of said tip is 2 to 15 mm.

6. A filter cigarette according to claim 5, wherein said length of said tip is 5 mm.

7. A filter cigarette according to claim 4, wherein said tip is made of a tow of acetate fibers.

8. A filter cigarette according to claim 4, wherein said tip is arranged between a filter portion and a cigarette.

9. A filter according to claim 1 wherein the filter rod includes a wrapper having air permeability.

10. A filter cigarette in which a filter according to claim 9 is attached to a cigarette by said wrapper constituting a ventilating tipping overwrap.

11. A filter cigarette according to claim 10 wherein, in use, the amount of ventilating air entering the filter through the tipping overwrap constitutes 20% of more of the total amount of air entering the filter.

12. A filter cigarette according to claim 11, wherein said ventilating air is introduced into the filter through perforations.

13. A filter cigarette according to claim 11 wherein said ventilating air constitutes 70 to 80% of said total amount of air.

14. A filter cigarette comprising a filter according to claim 1 attached to a cigarette by a ventilating tipping overwrap.

* * * * *